US006141607A

United States Patent [19]

Hergert-Mückusch et al.

[11] Patent Number: 6,141,607

[45] Date of Patent: Oct. 31, 2000

[54] CONTROL PROCESS FOR TRACK-BOUND VEHICLES

[75] Inventors: Ferdinand Hergert-Mückusch, Egmating; Andreas Schief, München, both of Germany

[73] Assignee: Siemens Aktiengesellschaft, Munich, Germany

[21] Appl. No.: 09/029,910

[22] PCT Filed: Aug. 8, 1996

[86] PCT No.: PCT/DE96/01496

§ 371 Date: Mar. 9, 1998

§ 102(e) Date: Mar. 9, 1998

[87] PCT Pub. No.: WO97/09217

PCT Pub. Date: Mar. 13, 1997

[30] Foreign Application Priority Data

Sep. 7, 1995 [DE] Germany ..... 195 33 128

[51] Int. Cl.[7] ..... G06F 165/00

[52] U.S. Cl. ..... 701/19; 701/117; 246/167 R

[58] Field of Search ..... 701/19, 20, 117, 701/118, 119, 204; 246/3, 4, 167 R, 182 R

[56] References Cited

U.S. PATENT DOCUMENTS

| | | | |
|---|---|---|---|
| 4,179,739 | 12/1979 | Virnot | 701/20 |
| 5,440,489 | 8/1995 | Newman | 701/20 |
| 5,623,413 | 4/1997 | Matheson et al. | 701/20 |
| 5,836,529 | 11/1998 | Gibbs | 701/19 |

*Primary Examiner*—Gary Chin
*Attorney, Agent, or Firm*—Hill & Simpson

[57] ABSTRACT

A method for controlling track-bound vehicles in which prescribed route networks and route for track-bound vehicles ($F_n$) are used to determine forecast delays $E(V_k^n)$ for the vehicles ($F_n$), a destination function ($\psi$) which quantifies the various aspects of causes of delay or aspects which lead to a need to control the individual vehicles ($F_n$) is minimized, and the method of steepest descent determines control values ($M_k^n$) by means of which the individual vehicles ($F_n$) are controlled.

40 Claims, 4 Drawing Sheets

CONTROL PROCESS FOR TRACK-BOUND VEHICLES

BACKGROUND OF THE INVENTION

The invention relates to a network of track-bound vehicles which cover prescribed routes. Optimum control of the vehicles requires taking into account a plurality of boundary conditions, for example that in a network intensively covered by vehicles, the passengers typically do not arrive at the respective stopping places at the envisaged departure times of the vehicles, but take the next available vehicle in the desired direction.

Moreover, high-frequency networks are subject to random effects in many regards. If, because of the fluctuations in the influx of the passengers, or because of delays to the vehicles there are more passengers than usual standing at the stopping place, the stopping time increases correspondingly due to the lengthened boarding process, and the spacing from the predecessor train increases. Because of this small delay, however, on average, more passengers than usual board at the next stopping place, and the delay of the train lengthens further.

It is therefore a case of a reinforcing random feedback which in the final analysis has the effect that an overcrowded, late vehicle is running immediately in front of a sparsely occupied vehicle.

Furthermore, the journey times of the vehicles between the stopping places are likewise subject to random fluctuations, for example caused by deviations from normal operation inside the vehicle, on the route or in any signalling engineering present.

Relatively serious disturbances occurring at some points and causing delays to the vehicles can also occur during the stops at the stopping places.

It has been found that many random small or individual relatively serious disturbances have the effect that lacking control of the vehicles the delays grow exponentially given an average passenger density, which can lead to substantial problems.

A method for determining a minimum of a multidimensional function is known, for example, as a method of steepest descent. An efficient method for determining the gradient of a multidimensional function is known as the back-propagation algorithm (D. Rumelhart et al., Parallel Distributed Processing, Bradford Books, MIT Press, Cambridge, Mass., ISBN 0-262-68053-X, pages 381 to 362, 1987).

Furthermore, heuristic methods are known for controlling track-bound vehicles (S. Araya, Traffic Dynamics of Automated Transit Systems with Pre-established Schedules, IEEE Transactions On Systems, Man and Cybernetics, Vol. 14, No. 4, pages 677 to 687, July/August 1984; J. Bustinduy et al., Timetable and Headway Control, Computers in Railway Operations, Computational Mechanics Publication, Southhampton, pages 317 to 336, 1987).

Also known is a deterministic model for controlling track-bound vehicles (V. Van Breusegem et al., Traffic Modelling and State Feedback Control for Metro Lines, IEEE Transactions on Automatic Control, Vol. 36, No. 7, pages 770 to 784, July 1991).

The methods which use local heuristics to control track-bound vehicles are subject to some limitations and thus harbour some disadvantages. These methods are all based on a local approach, that is to say the control instruction to a vehicle is determined only on the basis of information relating to the location of direct predecessor and successor trains. Information relating to more remote vehicles is not taken into account in controlling the vehicles. Furthermore, no actual optimum solution for controlling the vehicles is determined, since the methods are based exclusively on heuristic approaches. The applicability of these methods is, further, limited to simple route networks with only one line.

The deterministic method for controlling the track-bound vehicles also does not offer an optimum solution for controlling the vehicles, since insufficient account is taken of uncertainties such as, for example, irregular delays, determined by random effects, such as, for example, the delays in boarding and alighting processes, or random delays in the journey times of the vehicles between two stopping places.

SUMMARY OF THE INVENTION

It is the object of the invention to specify a method which renders possible global optimum control of all track-bound vehicles running in a specified route network.

In an embodiment, the invention provides a method for controlling track-bound vehicles ($F_n$; n=1 . . . m), comprising the following steps:

(a) determining forecast delays (E ($V_k^n$); k=1 . . . 1) for each vehicle ($F_n$) in the sequence of an order of determination (EO) for all stopping places (k) which the respective vehicle ($F_n$) approaches in a forecasting period;

(b) a destination function (ψ) in the reverse sequence of the order of determination (EO) by using a method of steepest descent which determines new control values ($M_k^n$), at least one of the following components being taken into account in the destination function (ψ):

a weighted sum $$\left(\sum_{n,k}(\alpha_k^n(E(V_k^n)))^p\right)$$

over at least some forecast delays (E ($V_k^n$); k=1 . . . 1);

a weighted maximum delay $$\left(\max_{n,k} E(V_k^n)\right)$$

of a vehicle ($F_n$);

a weighted sum $$\left(\sum_{n,k}\gamma_k^n e^{-\delta E(A_k^n)}\right)$$

over an unexpected spacing (E ($A_k^n$)) of the respective vehicle ($F_n$) from its direct predecessor at the stopping place (k);

a weighted sum $$\left(\sum_{n,k}\varepsilon|M_k^n|\right)$$

over at least some of the control values ($M_k^n$); and (c) using the control values ($M_k^n$) obtained by the method of steepest descent to control the respective vehicles ($F_n$).

Delays are forecast starting from a nonlinear stochastic model which takes account both of the prescribed routes which the vehicles cover, and of the sequence in which the vehicles cover the routes. A destination function which, by means of application-specific weightings, takes account both of delays and of other parameters which influence control, is minimized using a method of steepest descent which determines new control values for controlling the vehicles.

This mode of procedure provides global optimum control which can even be adapted to the respective control problem in an application-specific fashion. It is even possible when exercising control to take account, by weighting the summands inside the destination function, of different aspects which are to be particularly stressed during optimization.

Global optimization is rendered possible by taking account of all vehicles, that is to say of the forecast delays of all vehicles. The global optimization is thus no longer dependent exclusively on the respective predecessor vehicle of the vehicle to be controlled or of the immediate successor vehicle.

Owing to the use of a nonlinear stochastic model, random effects which cannot be predicted deterministically are taken into account to a suitable extent inside the destination function. By virtue of the periodic repetition of the optimization of the destination function while taking account of the temporal change in the observed values entered in the destination function, the control values are always kept at the current level independently of the periodicity interval of the determination of the control values.

By virtue of the fact that the various constants which strongly influence the determination of the boarding/alighting times are determined during the journey, the nonlinear stochastic model, and thus also the control of the vehicles which is bound up therewith, are substantially improved.

In accordance with another feature of the invention, it possible to take account of additional boundary conditions when determining the control values, and this likewise contributes to improving the method.

These and other features and aspects of the invention will become clear in the following detailed description of a few typical exemplary embodiments with reference to the accompanying drawings.

DETAILED DESCRIPTION OF THE PRESENTLY PREFERRED EMBODIMENTS

The invention will be explained further with the aid of FIGS. 1 to 7.

Figure 1:
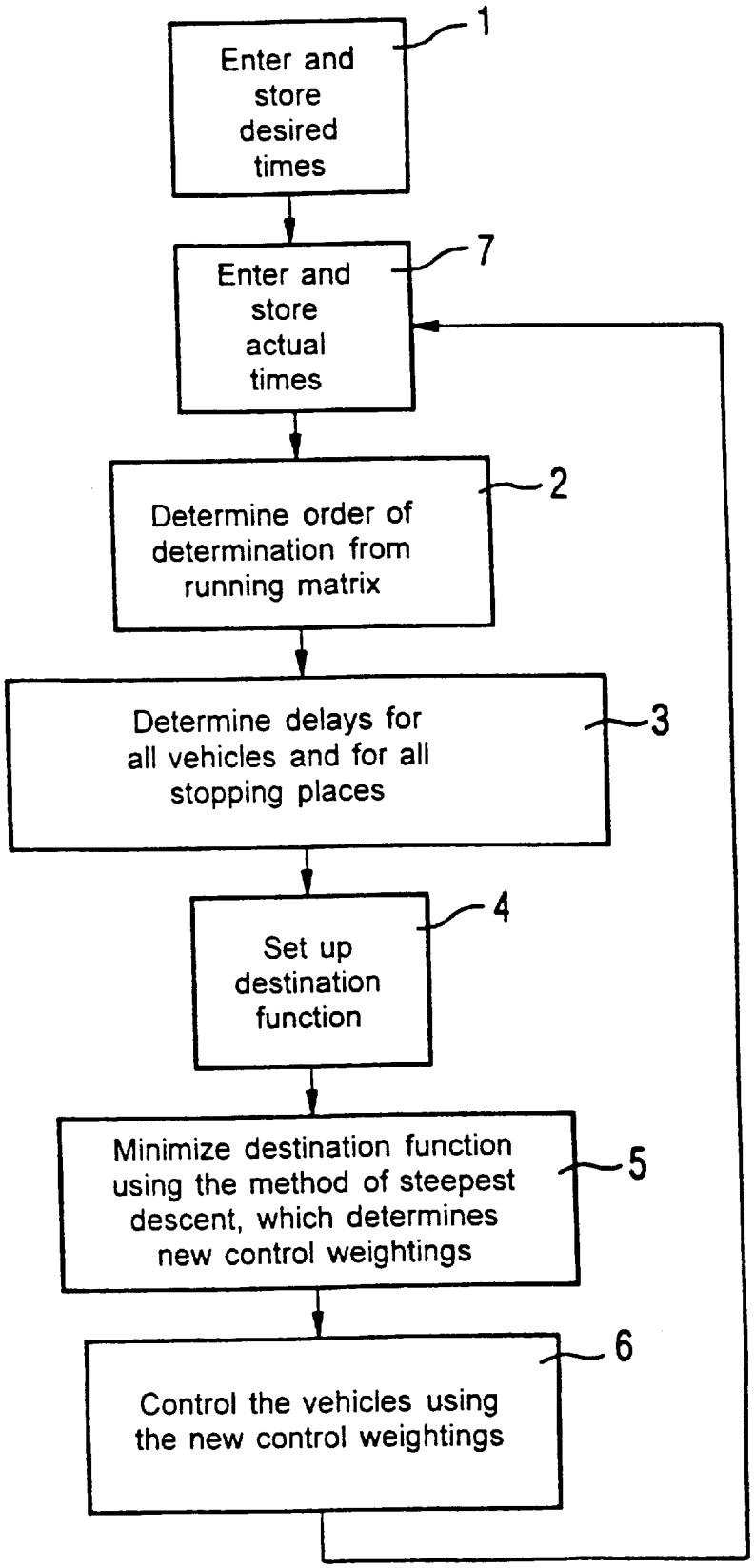
FIG. 1 shows a flowchart which represents individual method steps in the method.

Individual method steps are represented in FIG. 1.

Desired times $T_k^n$ which prescribe a desired departure time of a vehicle $F_n$ from a stopping place k in each case are entered into a data base in a first step 1.

This step is carried out only in the case of controlling track-bound vehicles $F_n$ which must keep to a prescribed timetable and which are therefore assigned desired times $T_k^n$ for the departure time of the vehicle $F_n$ from a stopping place k.

A first index n is a natural number in the range from 1 to m and uniquely identifies each track-bound vehicle $F_n$, which is provided in a route network. Each stopping place k is uniquely identified by a value between 1 and l. In this case, m designates the number of vehicles $F_n$ and l the number of stopping places k.

In the first step 1, a current time of day T is entered for the vehicles $F_n$ to which no desired time is assigned, that is to say for which no prescribed timetable exists.

The desired times $T_k^n$, or the current clock time T are stored by the computer which has entered the data.

In a further step 7, actual times which provide information, for example, relating to actual arrival times and departure times of the vehicles $F_n$, are entered by the computer carrying out the method and are stored in a memory of the computer.

A running matrix FM is then produced on the basis of the route network provided and of any requirements relating to the sequence in which the vehicles $F_n$ cover individual sections of the route network. An order of determination EO is determined in step 2 from the running matrix FM.

The order of determination EO fixes the sequence in which the forecasts for the individual vehicles $F_n$ and the individual stopping places k, which are determined later on, are produced.

Forecast delays $E(V_k^n)$ are determined in step 3 for all vehicles $F_n$ and for all stopping places k at which the vehicles $F_n$ will stop.

Furthermore, a destination function $\psi$ which is minimized in step 5 using a method of steepest descent is set up in step 4. When minimizing the destination function $\psi$, new control values $M_k^n$ are determined for each vehicle $F_n$ and each stopping place k by using the method of steepest descent.

The new control values $M_k^n$ are used to control the individual vehicles $F_n$ 6.

Running matrix FM and order of determination BO

FIGS. 2 and 3 and FIGS. 4 and 5 respectively represent an exemplary embodiment which describes in simplified form how the running matrix FM and the order of determination EO are produced. These two simple examples do not in any way, however, limit the general validity of the procedure for determining the running matrix FM and the order of determination EO, but are intended merely to illustrate the procedure in a clear way.

Figure 2:
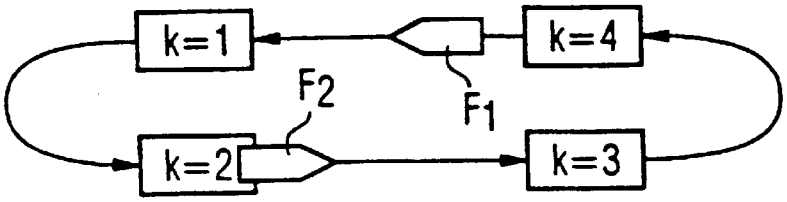
FIG. 2 shows a sketch representing a route network for explaining the first exemplary embodiment of the invention.

A route network with two vehicles $F_1$ and $F_2$ and four stopping places k (l=4) is represented in FIG. 2.

The running matrix FM is constructed from cells, each cell representing a doubly indicated object. Each cell is indicated by the vehicle $F_n$ and by the respective stopping place k.

The following elements are assigned to each cell, that is to say to each object:

a cell state which can assume the states of new, arrived, or departed.

The cell state is in the state of "new" whenever the vehicle $F_n$ has not yet arrived at the respective stopping place k. The state is that of "arrived" if, although having arrived at the respective stopping place k, the vehicle $F_n$ has not yet departed again. The state is that of "departed" if the vehicle $F_n$ has left the stopping place k again, a reference to the cell of the vehicle $F_n$ which has stopped at the stopping place k immediately before the vehicle which indicates the current cell, a reference to the cell of the vehicle $F_n$ which has stopped at the stopping place k immediately after the vehicle by which the current cell is indicated, a reference to the cell which is indicated by the platform k which is approached as nearest by the vehicle $F_n$, a reference to the cell of the stopping place k from which the vehicle $F_n$ has just "come", possibly the desired time, that is to say the planned departure time of the vehicle $F_n$ at the stopping place k, a forecast departure time ($E(Z_k^n)$ of the vehicle $F_n$ from the stopping place k;

if the actual departure time is already known from the past for the vehicle $F_n$ from the stopping place k, the actual value of the departure time of the vehicle $F_n$ is entered at this place, an actual arrival time of the vehicle $F_n$ at the stopping place k, the control value $M_k^n$ of the vehicle $F_n$ at the stopping place k for the respective control.

Figure 3:
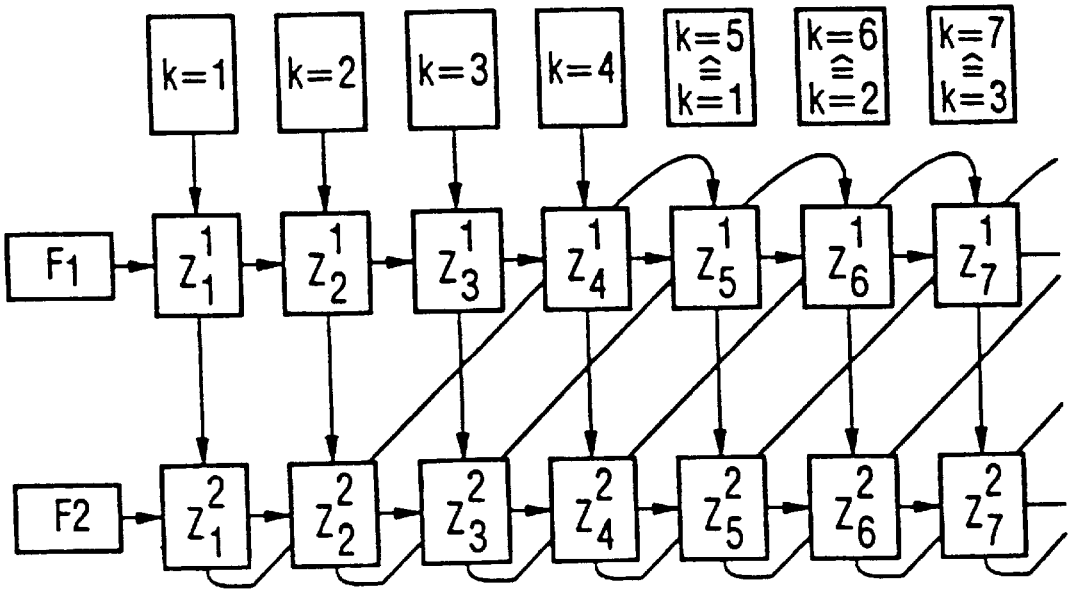
FIG. 3 shows a sketch in which a running matrix yielded from the route network represented in FIG. 2 is described.

The running matrix FM for the route network represented in FIG. 2 is described in FIG. 3. Here, a row of the running matrix FM corresponds in each case to the route of a vehicle $F_n$, and a column of the running matrix FM corresponds in each case to a stopping place k.

Thus, it holds for each cell that it describes the stopping of a vehicle $F_n$ at the stopping place k with the elements described above.

The right-hand neighbour of a cell thus corresponds to the next stopping place k+1 of the respective vehicle $F_n$. This is symbolized by an arrow going out from the stopping place k to the next stopping place k+1 of the vehicle $F_n$. The lower neighbour of a cell in a column stands for a stop of the respectively following vehicle $F_{n+1}$ at the stopping place k. In the exemplary embodiment shown in FIG. 3, this means that the fact that the vehicle $F_2$ regularly follows the vehicle $F_1$ is indicated by, in each case, an arrow from the cell of the vehicle $F_1$ to the respective cell of the same column in the row of the vehicle $F_2$.

As may be seen from the foregoing, the structure of instructions is thus represented with its temporal, causal dependencies in the running matrix FM.

Figure 4:
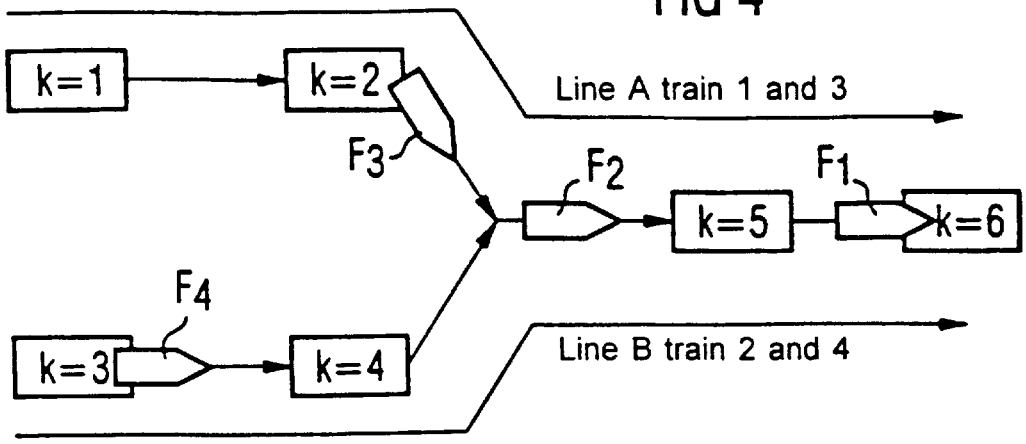
FIG. 4 shows a sketch which describes a route network of a second exemplary embodiment.
Figure 5:
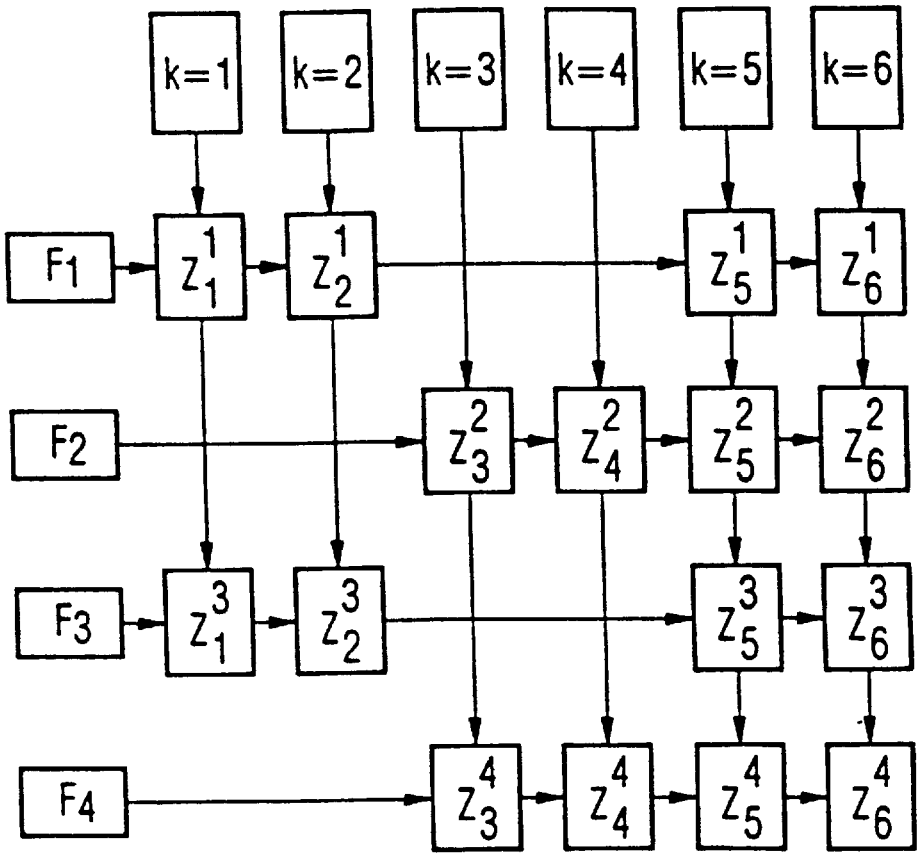
FIG. 5 shows a running matrix which is yielded from the route network represented in FIG. 4.
Figure 6:
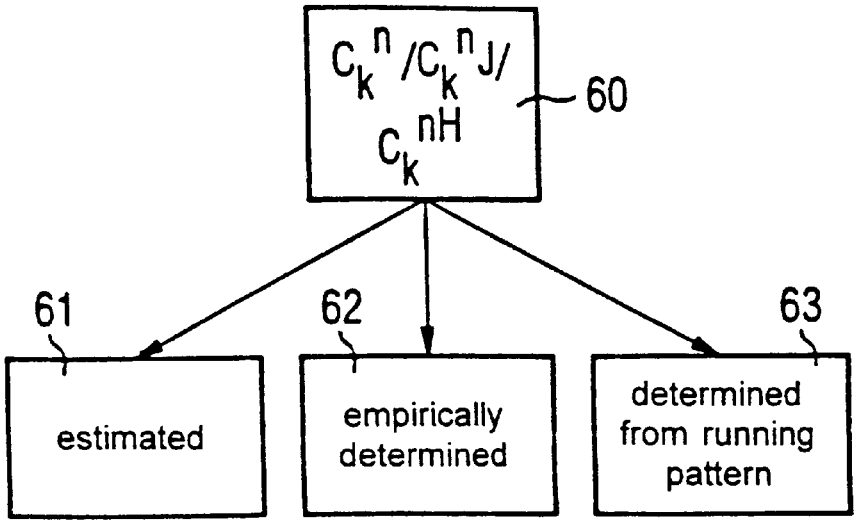
FIG. 6 shows a sketch in which various possibilities for determining a passenger constant are represented.

A second exemplary embodiment with a somewhat more complex route network which is represented in FIG. 4 is described in FIGS. 4 and 5.

The running matrix FM yielded from the route network and the timetables is represented in FIG. 5. The rules for forming the running matrix FM and the causal dependencies correspond to those described in the foregoing.

It becomes clear from these two exemplary embodiments that the mode of procedure for forming the running matrix FM starting from a given route network can be extended at will to any number of stopping places k and any number of vehicles $F_n$.

The order of determination EO for the cells of the running matrix FM in the current forecasting period is formed in such a way that when determining forecast departure times $E(Z_k^n)$ account is taken of as many known items of information as possible, that is to say, for example, entered actual arrival and departure times of the vehicles $F_n$ from the stopping places k.

The order of determination EO is thus a total order which is compatible with the half order prescribed by the arrows from the running matrix FM.

Basic model

A deterministic departure time $Z_k^n$ of a vehicle $F_n$ is yielded from the relationship:

$$Z_k^n = Z_k^n + F_k^n + H_k^n \tag{1}$$

Here, $Z_{k-1}^n$ designates the departure time of the vehicle $F_n$ at the preceding stopping place k−1, $F_k^n$ designates a random running time of the vehicle $F_n$ between the preceding stopping place k−1 and the stopping place k, and $H_k^n$ designates a stopping time of the vehicle $F_n$ at the stopping place k.

In the following, a number of boarding passengers $P_k^n$ of a vehicle $F_n$ at a stopping place k is assumed to be proportional to the time which has passed since the departure of a predecessor vehicle $F_{n-1}$. The result for the number of boarding passengers $P_k^n$ is:

$$P_k^n = C_k^{nJ} (Z_k^n - Z_k^{n-1}) \tag{2}.$$

Further or alternative assumptions relating to other functional relationships for the formation of the number of boarding passengers $P_k^n$ are, of course, possible and can be used at any time without limitations.

For example, for a vehicle $F_n$ of the line 1 at the stopping place k the result in general form for the number of boarding passengers $P_k^n$ for the case in which in an arbitrary route network an arbitrary number of vehicles belonging in each case to one line from a set L of lines are running and the passengers can in part also take vehicles $F_n$ of different lines in order to reach their destination is:

$$P_k^n = \sum_{\substack{L' \subset L \\ l \in L'}} C_{kL'}^n (Z_k^n - Z_{kL'}^n). \tag{3}$$

Here, the constants $C_{kL}^n$ designate the rush of all the passengers at the stopping place k who can travel precisely with the lines L' in order to reach their destination.

Departure times $Z_{kL}^n$ designate in each case the departure times of the vehicle, the last in time to precede the vehicle $F_n$, of a line from the set L' at the stopping place k by which the passengers were able to travel in order to reach their respective destination.

A passenger density $C_k^{nJ}$ designates a random proportionality constant of the passenger flow. A plurality of possibilities are provided for forming the passenger density $C_k^{nJ}$ in step 60 (compare FIG. 6).

A first possibility consists in estimating the passenger density $C_k^{nJ}$ at the start of the method on the basis of empirical values and assuming it to be constant in step 61.

A further possibility consists in determining the passenger density $C_k^{nJ}$ empirically during operation of the route network in step 62.

A third possibility consists in determining the passenger density $C_k^{nJ}$ from the running pattern of the respective vehicle $F_n$ by using the running pattern of the vehicle $F_n$ to deduce the total mass and thus also the loading of the vehicle, from which it is possible to deduce in step 63 the passenger density $C_k^{nJ}$ for each stopping place k.

A further assumption, which facilitates modelling, is made to the effect that the stopping time $H_k^n$ is proportional to the number of boarding passengers. The result for the stopping time in this simplified case is thus:

$$H_k^n = C_k^{nH} P_k^n \quad (4).$$

A further possibility for forming the stopping time $H_k^n$ consists, for example, in taking account of the opening times and closing times of the doors, and in taking account of the time which is required by the alighting passengers of the vehicle $F_n$ at the stopping place k.

Taking account of a door opening time $t_o$ and a door closing time $t_s$, as well as of an alighting constant $C_k^{nA}$ and a number of alighting passengers $P_k^{nA}$, the result for the stopping time $H_k^n$ in the case of more accurate modelling is:

$$H_k^n = t_o + t_s + C_k^{nH} P_k^n + C_k^{nA} P_k^{nA} \quad (5).$$

A boarding constant $C_k^{nH}$ and the alighting constant $C_k^{nA}$ can likewise be formed, like the passenger density $C_k^{nJ}$, in the three different ways of steps 61, 62, 63 described above (compare FIG. 6).

Making the simplified assumption that equations (1) and (3) hold, it follows in the case of combining the passenger density $C_k^{nJ}$ and the boarding constant $C_k^{nH}$ to form a passenger constant $C_k^n$ in accordance with $$C_k^n = C_k^{nJ} C_k^{nH} \quad (6)$$

that $$Z_k^n = Z_{k-1}^n + F_k^n + C_k^n (Z_k^n - Z_k^{n-1}) \quad (7)$$

This equation may now be solved for the deterministic departure time $Z_k^n$, yielding $$Z_k^n = \frac{1}{1 - C_k^n}(Z_{k-1}^n + F_k^n) - \frac{C_k^n}{1 - C_k^n} Z_k^{n-1}. \quad (8)$$

This designates the earliest possible departure time of a vehicle $F_n$ from the stopping place k. If the vehicle $F_n$ is tied to the desired time $T_k^n$, the actual departure time is yielded as $$Z_k^n = \max\left(\frac{1}{1 - C_k^n}(Z_{k-1}^n + F_k^n) - \frac{C_k^n}{1 - C_k^n} Z_k^{n-1}, T_k^n\right). \quad (9)$$

A deterministic delay $V_k^n$ is formed from the actual departure time $Z_k^n$ and a possible prescribed desired time $T_k^n$ as:

$$V_k^n = Z_k^n - T_k^n \geqq 0 \quad (10).$$

The local pattern of the vehicle $F_n$ at the stopping place k is thereby completely described.

Since, for an uncontrolled system, a delay of a vehicle $F_n$ at a stopping place k leads to an exponential growth in disturbance, control of the departure times with the aid of the control values $M_k^n$ is introduced. The formula for forming the actual departure time is then yielded as:

$$Z_k^n = \max\left(\frac{1}{1 - C_k^n}(Z_{k-1}^n + F_k^n) - \frac{C_k^n}{1 - C_k^n} Z_k^{n-1}, T_k^n\right) + M_k^n. \quad (11)$$

Figure 7:
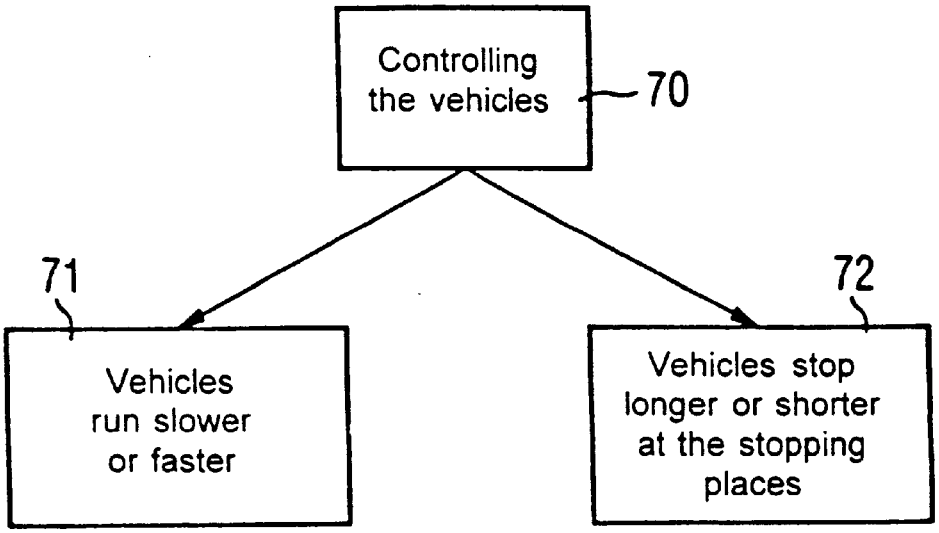
FIG. 7 shows a sketch in which various possibilities for controlling the track-bound vehicles are described.

The vehicle $F_n$ can be controlled in step 70 in different ways as represented, for example, in FIG. 7.

During the journey, the speed of the vehicle $F_n$ can be varied in accordance with the respective control value $M_k^n$. It can thus be braked and also be accelerated to a certain extent in step 71.

A further possibility for controlling the departure times $Z_k^n$ consists in permitting the vehicle $F_n$ located at the stopping place k to drive off earlier, or in determining in step 72 a longer stay of the vehicle $F_n$ at the stopping place k.

Determination of forecast delays $E(V_k^n)$

Since the actual values, input into the above model, of the random variables are not known, the expected values $E(Z_k^n)$, which are designated below as the forecast departure time $E(Z_k^n)$ are calculated.

Since the determination of the individual expected values is performed in the sequence of the order of determination EO, it is ensured that all the actual knowledge available, that is to say, actual arrival and departure times of the vehicles $F_n$ flow completely from the respective stopping places k into the forecast, that is to say into the forecast departure times $E(Z_k^n)$.

The result is thus the following formula:

$$E(Z_k^n) = E\left(\max\left(\frac{1}{1 - C_k^n}(Z_{k-1}^n + F_k^n) - \frac{C_k^n}{1 - C_k^n} Z_k^{n-1}, T_k^n\right)\right). \quad (12)$$

In order to simplify the determination of the forecast departure times $E(Z_k^n)$ the following mode of procedure can be used to determine the forecast departure times $E(Z_k^n)$ $$E(Z_k^n) \geq \max\left(E\left(\frac{1}{1 - C_k^n}\right)(E(Z_{k-1}^n) + E(F_k^n)) + E\left(\frac{C_k^n}{1 - C_k^n}\right)E(Z_k^{n-1}), T_k^n\right). \quad (13)$$

The determination of the approximated departure times $E(Z_k^n)$ is not now a problem, but presupposes knowledge of two expected values for the distribution of the passenger constants $C_k^n$. If the latter are not known, but only a single expected value $E(C_k^n)$, the following formulae can be used to approximate the more complicated expected values:

$$E\left(\frac{1}{1 - C_k^n}\right) \geq \frac{1}{1 - E(C_k^n)} \quad (14)$$

and $$E\left(\frac{C_k^n}{1 - C_k^n}\right) \geq \frac{E(C_k^n)}{1 - E(C_k^n)}. \quad (15)$$

Here, then, an order of determination EO and then all the forecast departure times $E(Z_k^n)$ are determined.

The order of determination EO must be updated before each new forecast as a function of the newly arrived process information, for example, all the new actually known arrival and departure times of the vehicles $F_n$ must be entered into the elements which are assigned to the individual cells of the running matrix FM.

Forecast delays $E(V_k^n)$ are determined in accordance with equation (10) from the forecast departure times $E(Z_k^n)$. In this case, the forecast delays $E(V_k^n)$ are determined in the following way:

$$E(V_k^n)=E(Z_k^n-T_k^n)=E(Z_k^n)-E(T_k^n)$$

E(.) respectively designating a statistical expected value for the respective variables specified in the brackets.

Destination function ψ

The destination function ψ is set up as follows as a function of the specific requirements placed on the respective control system:

$$\Psi = \sum_{n,k} \alpha_k^n (E(V_k^n))^p + \beta \max_{n,k} E(V_k^n) + \sum_{n,k} \gamma_k^n e^{-\delta E(A_k^n)} + \sum_{n,k} \varepsilon |M_k^n| + X \tag{16}$$

There is thus a summation in the destination function ψ over all vehicles $F_n$ and over all stopping places k which are reached in the forecasting period.

In this case, different weighting coefficients respectively determine what significance the individual summands are to receive inside the destination function ψ.

The weighting of the individual summands is a function of the special application, and is prescribed at the start of the method by taking account of the special applications.

The following weighting coefficients are used in the destination function ψ:

- first weighting factors $\alpha_k^n$ describe the influence of the forecast delays $E(V_k^n)$,
- a second weighting factor p describes the type of influence of the forecast delays $E(V_k^n)$,
- a third weighting factor β weights the influence of an expected maximum delay $_{n,k}^{max}=E(V_k^n)$ on the destination function ψ, that is to say the influence which a single, specifically the maximum, delay of a vehicle is to have on the total control of all vehicles $F_n$,
- fourth weighting factors $\gamma_k^n$ describe the influence of an expected spacing $E(A_k^n)$ of the respective vehicle $F_n$ from its immediate predecessor at the stopping place k,
- a fifth weighting factor δ describes the type of influence of the expected spacing $E(A_k^n)$ of the respective vehicle $F_n$ from its immediate predecessor at the stopping place k,
- a sixth weighting factor ε designates the influence of the control values on the destination function ψ, that is to say by appropriate dimensioning the sixth weighting factor E can prevent new control values $M_k^n$ from being determined to an excessive extent although there is scarcely any need for control,
- X describes a term for taking account of further optimization criteria for the destination function ψ. The term for taking account of further optimization criteria can contain, for example, aspects of peak load avoidance, explicitly prescribed following times, or of energy saving measures.

A simple numerical example is used below to represent a possible selection of the parameter values, which are freely prescribable in principle. This numerical example does not, however, limit the selection of parameter values in any way at all, since the selection of the parameter values is not critical with respect to the controller response.

An example is considered which has a total of 13 vehicles $F_n$ and any number of stopping places, it being the case that in this example a forecast of the individual times for 30 stopping places is respectively determined for each vehicle $F_n$.

The following parameter values have proved to be advantageous for this special case:

If an arbitrary timetable is prescribed in the system then, for example, only the first weighting factors $\alpha_k^n$, the second weighting factor p and the third weighting factor β, and thus only the first two summands of equation (16) are taken into account in the destination function ψ. This means, for example, that: for this example the value 0 is assigned to the fourth weighting factors $\gamma_k^n$, the fifth weighting factor δ, the sixth weighting factor ε, and the term X for taking account of further optimization criteria.

The value 1, for example, is assigned to the first weighting factors $\alpha_k^n$. The value 1, for example, is also assigned to the second weighting factor p.

The third weighting factor β is yielded, for example, from a product of the total number of vehicles $F_n$ and the number of stopping places for which a forecast is to be determined. The third weighting factor β is thus yielded for the numerical example as:

$$\beta=13\cdot 20=309.$$

This selection of the parameter values is advantageous for the case in which the influence of the vehicle $F_n$ with the longest forecast delay $E(V_k^n)$ has approximately the same influence on the destination function ψ as the average of the forecast delays $E(V_k^n)$ of all other vehicles $F_n$.

However, if it is desirable that, for example, the influence of the vehicle $F_n$ with the longest forecast delay $E(V_k^n)$ on the destination function ψ should be particularly large, it is desirable, for example, to assign the first weighting factors $\alpha_k^n$ the value 0, for example. The third weighting factor β is advantageously assigned the value 1, for example, in this case.

If, however, an average response of the forecast delay $E(V_k^n)$ is principally to be evaluated in the destination function ψ, it is advantageous, for example, to assign the first weighting factors $\alpha_k^n$ the value 1, for example. The third weighting factor β is advantageously assigned the value 0, for example, in this case.

If no timetable is prescribed in the system then, for example, the first weighting factors $\alpha_k^n$ are assigned the value 1 or the value 0. The second weighting factor p is likewise assigned the value 1, for example.

For the special case in which no timetable is prescribed, it is advantageous to assign the desired times $T_k^n$ the current time of day, for example, and to determine the forecast delay $E(V_k^n)$ with this assumption.

The third weighting factor β is likewise, for example, determined in the way described above. For the numerical example, the third weighting factor β is thus yielded for the exemplary case that no timetable is prescribed as:

$$\beta=13\cdot 20=309.$$

The fourth weighting factors δ are assigned the numerical value 800,000, for example.

The fifth weighting factor δ is assigned the value 0.02, for example, the fifth weighting factor δ being yielded, for example, from the reciprocal of an average temporal spacing of the vehicles $F_n$ from one another.

The sixth weighting factor ε is assigned, for example, a value in the range between 1 and 20, it being advantageous to select a larger value for the sixth weighting factor ε if it is to be expected that excessively large disturbances do not occur in the system. However, if it is to be expected that disturbances will arise, it is advantageous to select a smaller value for the sixth weighting factor ε.

The term X for taking account of further optimization criteria is assigned the value 0 in turn, for example.

It is advantageous, furthermore, to select the parameter values in a way such that the individual terms $$\sum_{n,k}(\alpha_k^n(E(V_k^n)))^p,\ \beta\max_{n,k}E(V_k^n),\ \sum_{n,k}\gamma_k^n e^{-\delta E(A_k^n)},\ \sum_{n,k}\varepsilon|M_k^n|$$

the destination function ψ yield values of the same order of magnitude.

It is to be reemphasized that the specific selection of the parameter values is extremely non-critical and results directly from the respective application itself.

Further optimization criteria which are yielded from the special applications can, of course, be taken into account in this term X.

The destination function ψ is minimized using a method of steepest descent in the reverse sequence of the order of determination EO.

The method of steepest descent supplies new control values $M_k^n$, which are used to control the vehicles $F_n$ in a further step.

The method in D. Rumelhart, Parallel Distributed Processing, Bradford Books, MIT Press, Cambridge, Mass., ISBN 0-262-68053-X, pages 318 to 362, 1987 can be used as method of steepest descent, that is to say as a method for calculating the gradient.

Further variants of method of steepest descent which are known to any person skilled in the art can be used without limitation within the scope of this method.

In a development of the method, it is provided to take account of boundary conditions in the control values $M_k^n$.

The boundary conditions can, for example, in fixing train sequences, in accordance with the optimization of the controlling of the vehicles $F_n$, for example at intersections of the route network consist in that, instructions to the vehicles $F_n$ as to how they are to cover the route sections are changed as against the original sequence.

It is also possible to take into account convoy journeys when forming the new control values $M_k^n$, that is to say, it is possible to insert additional journeys which cover a part of the line of a route network in the form of a convoy.

Furthermore, it is possible to incorporate connections into the controlling of the vehicles $F_n$. This can, for example, lead to a vehicle $F_n$ waiting for a delayed vehicle which is likewise approaching the stopping place k, in order to be able still to pick up its passengers.

Furthermore, it is possible to take into account a boundary condition in the avoidance of tunnel stops, that is to say of additional stops in a tunnel, for example by stopping the vehicle $F_n$ at a stopping place which is still ahead of a tunnel, should a stop inside the tunnel otherwise be unavoidable.

It is provided, furthermore, that the controller reports to a management centre possible conflicts which it has determined by the determination of the forecast delays $E(V_k^n)$, which management centre then possibly changes desired times $T_k^n$ or journey sequences of the individual vehicles $F_n$, reports these to the controller, which then produces a new running matrix FM and a new order of determination EO on the basis of the data newly transmitted from the management centre, and then in turn determines new control values $M_k^n$ therefrom.

In order to eliminate problems which are produced by the lack of differentiability of the destination function ψ, it is possible to provide in addition a smoothing of the non-differentiable points of the destination function ψ using a smoothing function which approximates the characteristic of the non-differentiable part of the destination function ψ. It is possible in this case to use all functions which have smoothing properties and approximate the non-differentiable point with adequate accuracy for the application in each case.

A further possibility for treating the problem of the lack of differentiability of the destination function ψ consists in using a unilateral differential quotient of the destination function ψ at these points.

Although modifications and changes may be suggested by those skilled in the art, it is the invention of the inventors to embody within the patent warranted hereon all changes and modifications as reasonably and properly come within the scope of the contribution to the art.

What is claimed is:

1. A method for controlling track-bound vehicles ($F_n$; n=1 . . . m), comprising the following steps:

(a) determining forecast delays ($E(V_k^n)$; k=1 . . . 1) for each vehicle ($F_n$) in the sequence of an order of determination (EO) for all stopping places (k) which the respective vehicle ($F_n$) approaches in a forecasting period;

(b) minimizing a destination function (ψ) in the reverse sequence of the order of determination (EO) by using a steepest descent method which determines new control values ($M_k^n$), at least one of the following components being taken into account in the destination function (ψ):

a weighted sum $$\left(\sum_{n,k}\alpha_k^n(E(V_k^n))^p\right)$$

over at least some forecast delays ($E(V_k^n)$; k=1 . . . 1)

a weighted maximum delay $$\left(\max_{n,k}E(V_k^n)\right)$$

of said vehicle ($F_n$);

a weighted sum $$\left(\sum_{n,k}\gamma_k^n e^{-\delta E(A_k^n)}\right)$$

over an unexpected spacing ($E(A_k^n)$) of the respective vehicle ($F_n$) from its direct predecessor at the stopping place (k);

a weighted sum $$\left(\sum_{n,k}\varepsilon|M_k^n|\right)$$

over at least some of the control values ($M_k^n$); and (c) using the control values ($M_k^n$) obtained by the method of steepest descent to control the respective vehicles ($F_n$).

2. A method according to claim 1, in which the order of determination (EO) is given by a stored running matrix (FM) in which the routes of the vehicles (Fn) and the sequence in which the individual vehicles ($F_n$) cover individual route sections are entered.

3. A method according to claim 1 or claim 2, in which the forecast delays ($E(V_k^n)$) are determined by the relationship:

$$E(V_k^n)=E(Z_k^n)-T_k^n,$$

wherein (a) ($E(Z_k^n)$) designates a forecast departure time of the respective vehicle (n) from the stopping place (k); and (b) $T_k^n$ describes a prescribed desired time at which the respective vehicle ($F_n$) is to drive off from the stopping place (k).

4. A method according to claim 3, in which the forecast departure times $E(Z_k^n)$ are determined by:

$$E(Z_k^n) = \max\left[E\left(\frac{1}{1-C_k^n}\right)\cdot(E(Z_{k-1}^n)+E(F_k^n))+E\left(C\frac{n}{1-C_k^n}\frac{k}{}\right)\cdot E(Z_{k-1}^n, T_k^n\right]$$

wherein, (a) $C_k^n$ is a passenger constant which is yielded from the product of a passenger density ($C_k^{nJ}$) and a boarding constant ($C_k^{nH}$); and (b) ($E(F_k^n)$) describes a forecast journey time which is required by the respective vehicle ($F_n$) for the journey between two stopping places (k−1 and k).

5. A method according to claim 1 or 2, in which the forecast delays ($E(V_k^n)$) are determined by the relationship:

$$E(V_k^n)=E(Z_k^n)$$

wherein, (a) ($E(Z_k^n)$) designates a forecast departure time of the respective vehicle ($F_n$) from the stopping place (k); and (b) T describes the current time of day.

6. A method according to claim 5, in which the forecast departure times ($E(Z_k^n)$) are determined by the relationship:

$$E(Z_k^n) = \max\left[E\left(\frac{1}{1-C_k^n}\right)\cdot(E(Z_{k-1}^n)+E(F_k^n))+E\left(C\frac{n}{1-C_k^n}\frac{k}{}\right)\cdot E(Z_{k-1}^n, T\right]$$

wherein, (a) $C_k^n$ is a passenger constant which is yielded from the product of a passenger density ($C_k^{nJ}$) and a boarding constant ($C_k^{nH}$) ; and (b) (E ($F_k^n$)) describes a forecast journey time which is required by the respective vehicle ($F_n$) for the journey between two stopping places (k−1 and k).

7. A method according to claim 4, in which the term $$E\left(\frac{1}{1-C_k^n}\right)$$

is approximated by the inequality $$E\left(\frac{1}{1-C_k^n}\right) \geq \frac{1}{1-E(C_k^n)}$$

8. A method according to claim 6, in which the term $$E\left(\frac{1}{1-C_k^n}\right)$$

is approximated by the inequality $$E\left(\frac{1}{1-C_k^n}\right) \geq \frac{1}{1-E(C_k^n)}$$

9. A method according to claim 4, in which the passenger constant ($C_k^n$) is estimated at the start of the method.

10. A method according to claim 5, in which ($C_k^n$) is a passenger constant resulting from the product of a passenger density ($C_k^{nJ}$) and a boarding constant ($C_k^{nH}$) and the passenger constant ($C_k^n$) estimated at the start of the method.

11. A method according to claim 5, in which ($C_k^n$) is a passenger constant resulting from the product of a passenger density ($C_k^{nJ}$) and a boarding constant ($C_k^{nH}$) and the passenger constant ($C_k^n$) is estimated at the start of the method.

12. A method according to claim 7, in which the passenger constant ($C_k^n$) is estimated at the start of the method.

13. A method according to claim 4, comprising the step of determining the passenger constant ($C_k^n$), empirically at the start of the method.

14. A method according to claim 5, comprising the step of determining the passenger constant ($C_k^n$) empirically at the start of the method.

15. A method according to claim 6, comprising the step of determining the passenger constant ($C_k^n$) empirically at the start of the method.

16. A method according to claim 7, comprising the step of determining the passenger constant ($C_k^n$) empirically at the start of the method.

17. A method according to claim 9, in which the passenger constant ($C_k^n$) is determined periodically during the journey from a running pattern of the respective vehicle ($F_n$).

18. A method according to claim 13, in which the passenger constant ($C_k^n$) is determined periodically during the journey from a running pattern of the respective vehicle ($F_n$).

19. A method according to claim 1 in which the control of the vehicles ($F_n$) consists in that the speed of the individual vehicles ($F_n$) is varied for the vehicles ($F_n$) between the stopping places.

20. A method according to claim 1 in which boundary conditions are taken into account when determining the control value ($M_k^n$).

21. A method according to claim 1 in which forecast conflicts are determined by the forecast delays $E(V_k^n)$.

22. A method according to claim 1 in which the control of the vehicles ($F_n$) consists in that a stopping time during which a respective vehicle (Fn) is located at a stopping place is varied in accordance with the control values ($M_k^n$).

23. A method according to claim 4, in which the term $$E\left|\frac{C_k^n}{1-C_k^n}\right|$$

is approximated by the inequality $$E\left|\frac{C_k^n}{1-C_k^n}\right| \geq \frac{E(C_k^n)}{1-E(C_k^n)}$$

24. A method according to claim 6, in which the term $$E\left|\frac{C_k^n}{1-C_k^n}\right|$$

is approximated by the inequality $$E\left|\frac{C_k^n}{1-C_k^n}\right| \geq \frac{E(C_k^n)}{1-E(C_k^n)}$$

25. A method according to claim 4, in which the passenger density $C_k^{nJ}$ is estimated at the start of the method.

26. A method according to claim 5, in which the passenger density $C_k^{nJ}$ is estimated at the start of the method.

27. A method according to claim 6, in which the passenger density $C_k^{nJ}$, is estimated at the start of the method.

28. A method according to claim 7, in which the passenger density $C_k^{nJ}$ is estimated at the start of the method.

29. A method according to claim 4, comprising the step of determining the passenger density $C_k^{nJ}$ empirically at the start of the method.

30. A method according to claim 4, comprising the step of determining the boarding constant $C_k^{nH}$ empirically at the start of the method.

31. A method according to claim 5, comprising the step of determining the passenger density $C_k^{nH}$ empirically at the start of the method.

32. A method according to claim 5, comprising the step of determining the boarding constant $C_k^{nH}$ empirically at the start of the method.

33. A method according to claim 6, comprising the step of determining the passenger density $C_k^{nJ}$ empirically at the start of the method.

34. A method according to claim 6, comprising the step of determining the boarding constant $C_k^{nH}$ empirically at the start of the method.

35. A method according to claim 7, comprising the step of determining the passenger constant ($C_k^n$) empirically at the start of the method.

36. A method according to claim 7, comprising the step of determining the boarding constant $C_k^{nH}$ empirically at the start of the method.

37. A method according to claim 9, in which the passenger density $C_k^{nJ}$ is determined periodically during the journey from a running pattern of the respective vehicle ($F_n$).

38. A method according to claim 9, in which the boarding constant $C_k^{nH}$ is determined periodically during the journey from a running pattern of the respective vehicle ($F_n$).

39. A method according to claim 13, in which the passenger density $C_k^{nJ}$ is determined periodically during the journey from a running pattern of the respective vehicle ($F_n$).

40. A method according to claim 9, in which the boarding constant $C_k^{nH}$ is determined periodically during the journey from a running pattern of the respective vehicle ($F_n$).

* * * * *